US010408025B2

(12) United States Patent
Harrington et al.

(10) Patent No.: US 10,408,025 B2
(45) Date of Patent: Sep. 10, 2019

(54) RETAINING AND POSITIONING END CAP FOR DOWNHOLE SETTING TOOL POWER CHARGES

(71) Applicant: Baker Hughes, a GE Company, LLC, Houston, TX (US)

(72) Inventors: Kevin Edgar Harrington, Hockley, TX (US); Gregory Hern, Porter, TX (US); Kent Meyer, Tomball, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 15/648,009

(22) Filed: Jul. 12, 2017

(65) Prior Publication Data

US 2019/0017356 A1 Jan. 17, 2019

(51) Int. Cl.

| | |
|---|---|
| ***E21B 43/1185*** | (2006.01) |
| ***E21B 43/116*** | (2006.01) |
| ***E21B 41/00*** | (2006.01) |
| ***E21B 23/06*** | (2006.01) |
| ***E21B 23/04*** | (2006.01) |
| ***E21B 17/02*** | (2006.01) |

(52) U.S. Cl.
CPC ..... *E21B 43/11857* (2013.01); *E21B 17/028* (2013.01); *E21B 23/04* (2013.01); *E21B 23/065* (2013.01); *E21B 41/0085* (2013.01); *E21B 43/116* (2013.01); *E21B 43/11855* (2013.01)

(58) Field of Classification Search
CPC ..... E21B 23/00; E21B 23/04; E21B 23/06; E21B 23/065; E21B 43/105; E21B 43/116; E21B 43/11855; E21B 43/11857; E21B 41/0085; E21B 17/028
See application file for complete search history.

(56) References Cited

U.S. PATENT DOCUMENTS

| | | | | |
|---|---|---|---|---|
| 5,392,860 | A * | 2/1995 | Ross | E21B 23/065 102/222 |
| 6,925,937 | B2 | 8/2005 | Robertson | |
| 8,534,367 | B2 * | 9/2013 | Carisella | E21B 23/04 166/102 |
| 9,051,830 | B2 * | 6/2015 | Tips | E21B 34/10 |
| 2018/0080298 | A1 * | 3/2018 | Covalt | E21B 23/065 |

* cited by examiner

*Primary Examiner* — Franklin D Balseca
(74) *Attorney, Agent, or Firm* — Parsons Behle & Latimer

(57) ABSTRACT

A downhole setting tool and method of using the setting tool, the setting tool including a firing head, an igniter, a housing connected to the firing head, a power charge positioned within a chamber of the housing, and a connector connecting a portion of the power charge to the firing head. The connector may be connected to the uphole end of the power charge. The connector may connect the power charge to an adapter that connects the power charge to the firing head. The connector may be a ring having an outer engagement feature that engages the adapter and an inner engagement feature that engages the power charge. The connector may be a collet including an outer engagement feature that engages the adapter and a plurality of fingers that engage the power charge. The ignitor is used to detonate the power charge to set a device within a wellbore.

21 Claims, 6 Drawing Sheets

RETAINING AND POSITIONING END CAP FOR DOWNHOLE SETTING TOOL POWER CHARGES

BACKGROUND

Field of the Disclosure

The embodiments described herein relate to power charge connectors for downhole setting tools and methods of using the same.

Description of the Related Art

A downhole setting tool may use a power charge to set a device within a wellbore. The power charge is detonated to generate the force required to set the device. For example, the force from the detonated power charge may move a piston causing the setting of the device. The power charge of the downhole setting tool may be used to set various devices in a wellbore as would be appreciated by one of ordinary skill in the art. For example, a downhole setting tool with a power charge may be used to set bridge plugs, cement retainers, packers, and various other downhole devices.

An electrical signal is typically sent down a conduit to the setting tool to actuate a primary igniter in the firing head of the setting tool. The actuation of the primary igniter is used to detonate the power charge, which is typically located downhole from the primary igniter in a chamber connected to the firing head via a cartridge seat. The downhole setting tool may include a secondary igniter that is used to detonate the power charge upon the actuation of the primary igniter. The primary igniter often comprises black powder (e.g., gun powder, a mixture of sulfur, charcoal, and saltpeter) that is ignited from the electrical signal.

It has been recognized that it would be beneficial to increase the reliability with which the power charge of downhole setting tools detonates and sets the downhole device. For example, on Jan. 13, 2017, Applicant filed U.S. patent application Ser. No. 15/406,040 entitled "SETTING TOOL POWER CHARGE INITIATION" that is directed to devices and methods for initiating or setting off a power charge, which is incorporated by reference herein in its entirety.

FIG. 6 shows an embodiment of known conventional downhole setting tool 200. The setting tool 200 may be the E-4 packer setting device which is available commercially from Baker Hughes Incorporated of Houston, Tex. The setting tool 200 includes a firing head 210 connected to an adapter 230, which is also referred to as a cartridge seat. The adapter 230 houses the primary igniter 220. The E-4 packer setting device also includes a secondary igniter 235 housed within the adapter 230, which is ignited by the actuation or ignition of the primary igniter 220. The actuation of the primary igniter 220 pushes the secondary igniter 235 towards the power charge 250 as shown by secondary igniter 235' shown in dash.

The power charge 250 includes an outer housing 255 and is positioned within a chamber 245 of a housing 240 connected to the firing head 210. The downhole side of the housing 240 is connected to a sub 280 that is connected to the device (not shown) to be set within the wellbore. The sub 280 provides communication with an actuation mechanism, such as a piston, configured to move and set the device upon the detonation of the power charge 250 as would be appreciated by one of ordinary skill in the art. The downhole end 252 of the power charge 250 is inserted into the chamber 245 of the housing 240 and the power charge 250 and the power charge 250 is pushed into the chamber 245 until the downhole end 252 is positioned within the sub 280. The housing 240 containing the power charge 250 is then connected to the firing head 210 and the adapter 230. The uphole end 251 of the power charge 250 includes an igniter 260 that helps to detonate the power charge 250 upon the ignition of the primary igniter 220 and the secondary igniter 235. As used herein, the uphole end refers to the end of an object that is closer to the opening of a wellbore at the surface in comparison to the other end of the object, referred to herein as the downhole end.

Conventional downhole setting tools that include power charges are very reliable and are used to set a large number of devices in a wellbore. However, even if conventional setting tools are 99% reliable, the removal of one setting tool and device out of one hundred from the wellbore is a potentially costly and time consuming operation. As the downhole tool 200 is run into the wellbore the power charge 250 may become misaligned with the primary igniter 220 and/or secondary igniter 235 potentially causing the power charge 250 to not detonate when the igniter(s) 220, 235 are actuated. For example, as the tool 200 traverses around a lateral in a wellbore the secondary igniter 235 may fall into a cavity as shown as 235' in FIG. 6 becoming misaligned with the power charge 250. A secondary igniter 235' in a misaligned positioned may fail to detonate the power charge 250. Other disadvantages may exist.

SUMMARY

The present disclosure is directed to power charge connectors for downhole setting tools and methods of use that overcome some of the problems and disadvantages discussed above.

One embodiment of the present disclosure is a downhole setting tool comprising a firing head, an igniter, a housing connected to the firing head, the housing including a chamber, a power charge that is positioned within the chamber of the housing, and a connector connecting a portion of the power charge to the firing head. The connector may be connected to an uphole end of the power charge. The downhole settling tool may include an adapter positioned between the firing head and the power charge. The connector may connect a portion of the power charge to the adapter and the power charge may be connected to the firing head via the adapter.

The power charge may include an outer housing and the connector may connect a portion of the outer housing to the adapter. The connector may include a ring having an outer engagement feature and an inner engagement feature. The outer engagement feature of the ring may engage a mating feature of the adapter and the inner engagement feature of the ring may engage a mating feature of the power charge. The connector may be a collet having a plurality of fingers. The collet may include an outer engagement feature configured to engage a mating feature of the adapter. Each of the plurality of fingers may include an inner engagement feature configured to engage a mating feature on the power charge.

The igniter may be actuated by an electrical signal from an electrical conduit. The actuation of the igniter detonates the power charge. The detonation of the power charge may set a tool within a wellbore. The actuation of the igniter may ignite a secondary igniter that detonates the power charge.

One embodiment of the present disclosure is a method of using a downhole setting tool. The method comprises attaching a connector to a power charge configured to be selectively detonate to set a device within a wellbore. The method comprises connecting the power charge to a portion of a downhole setting tool via the connector, wherein the downhole setting tool comprises an igniter that may be selectively actuated via an electrical signal via an electrical conduit.

The method may include running the downhole setting tool into the wellbore. The method may include detonating the power charge to set the device in the wellbore. Attaching the connector to the power charge may further comprise attaching the connector to an uphole end of the power charge. Connecting the power charge to the portion of the downhole setting tool may further comprise engaging a mating feature of an adapter of the downhole setting tool with an outer engagement feature of the connector.

One embodiment of the present disclosure is a power charge for a downhole setting tool comprising a power charge configured to be detonated to set a tool within a wellbore, the power charge having an uphole end and a downhole end when installed within the downhole setting tool, the power charge including an outer housing and a connector configured to attach to the uphole end of the power charge, the connector including an outer engagement feature. The connector may include an inner engagement feature configured to engage a mating feature on the housing of the power charge. The connector may be a collet having a plurality of fingers, wherein each finger includes the inner engagement feature.

One embodiment of the present disclosure is a method of actuating a downhole tool having an actuation mechanism for receiving a mechanical force generated by a detonation of a power charge in a downhole setting tool, the power charge having an uphole end and a downhole end when installed within the downhole setting tool, a connector including an outer engagement feature connected to the uphole end of the power charge. The method comprises selectively actuating an igniter in the downhole setting tool via an electrical signal to selectively detonate the power charge connected to a portion of the downhole setting tool via the connector. The method comprises generating a mechanical force upon detonation of the power charge and transmitting the mechanical force to the actuation mechanism adapted to actuate the downhole tool. The actuation of the downhole tool may comprise one or more of setting, releasing, or shifting the downhole tool. The downhole tool may comprise one or more of a packer, frac plug, bridge plug, valve, and sleeve.

Figure 1:
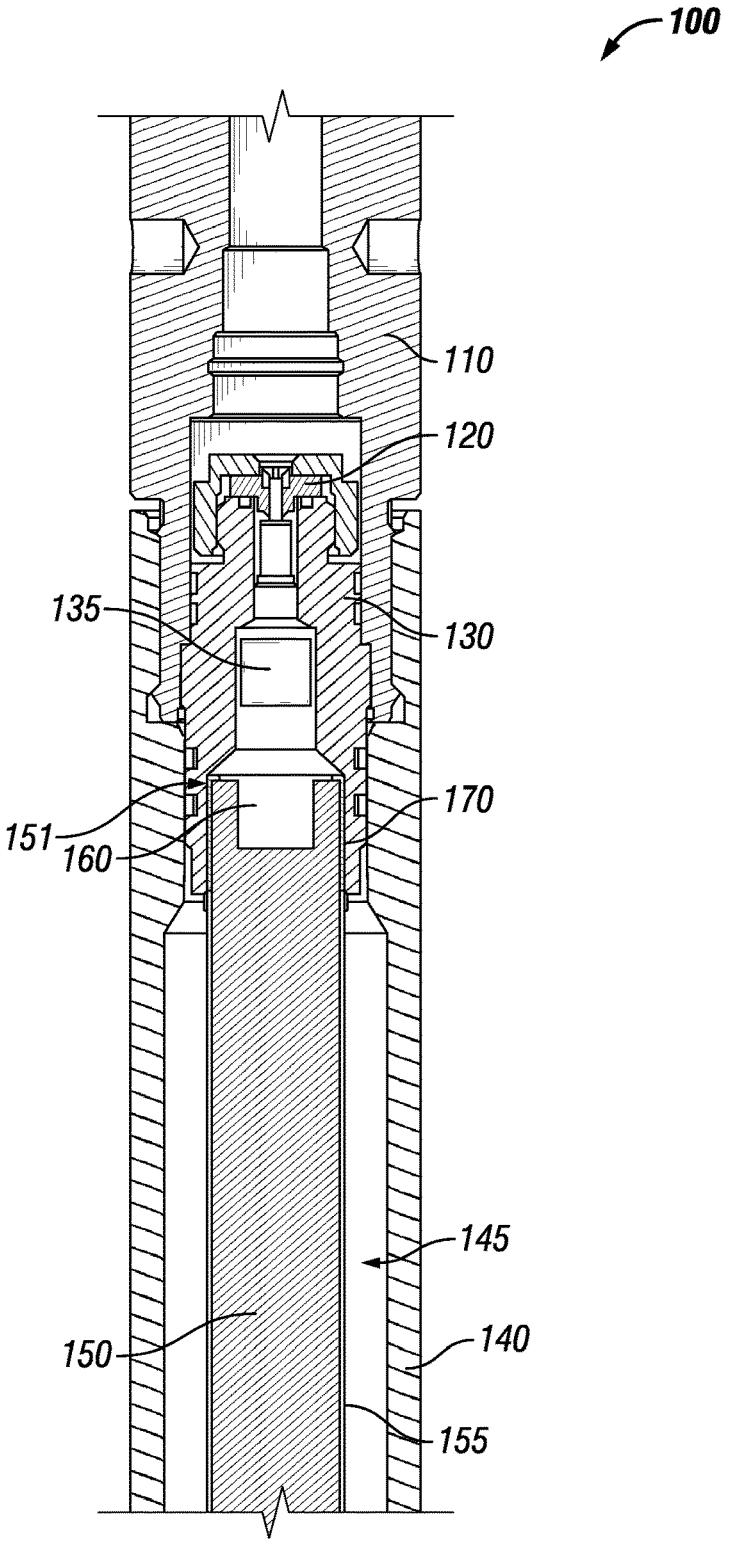
FIG. 1 shows an embodiment of a downhole setting tool that includes a power charge.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a setting tool 100 that includes a power charge 150. The detonation of the power charge 150 is used to set, release, and/or shift a downhole device, such as, but not limited to, a bridge plug, packer, frac plug, liner, liner hanger, valve, or sleeve in a wellbore as would be appreciated by one of ordinary skill in the art having the benefit of this disclosure. The setting tool 100 includes a firing head 110, primary igniter 120, and an adapter (also referred to as a cartridge seat) 130 as with conventional setting tools. The setting tool 100 may include a secondary igniter 135 that is ignited and pushed towards the power charge 150 upon the ignition or actuation of the primary igniter 120. The power charge 150 includes an uphole end 151, a downhole end 152 (shown in FIG. 2C), and an outer housing or casing 155. The casing 155 of the power charge 150 may be comprised of plastic, cardboard, or various other materials as would be appreciated by one of ordinary skill in the art having the benefit of this disclosure.

The power charge 150 is positioned within a chamber 145 of a housing 140 that is connected to the firing head 110. The downhole end (not shown) of housing 140 is configured to be connected to a downhole device to be set by the detonation of the power charge 150 as would be appreciated by one of ordinary skill in the art having the benefit of this disclosure. For example, a connecting sub may be connected to the downhole end of the housing 140 to connect the chamber 145 to an actuation mechanism, such as a piston, that sets, releases, and/or shifts the device upon the detonation of the power charge 150. The detonation of the power charge 150 generates a mechanical force that is transmitted to the actuation mechanism, which is adapted to actuate the downhole tool. The power charge 150 includes an igniter 160 in the uphole end 151 of the power charge 150 that helps to detonate the power charge 150 upon the ignition of igniter 120 and igniter 135.

Figure 6:
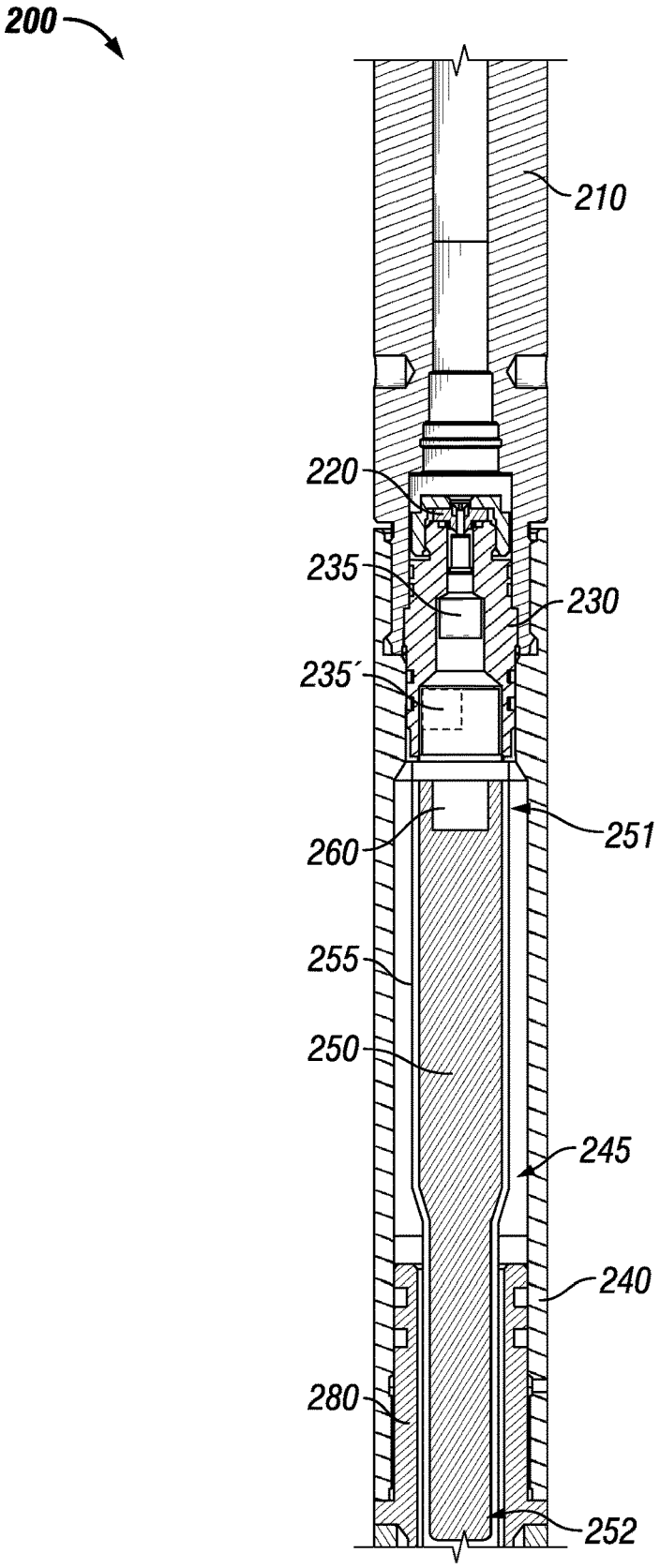
FIG. 6 (Prior Art)
FIG. 6 shows a prior art downhole setting tool that includes a power charge.

The setting tool 100 includes a connector 170 that attaches the upper end 151 of the power charge 150 to the adapter 130. The connector 170 provides that the power charge 150 will remain in alignment with the igniter(s) 120, 135, which may increase the reliability that the power charge 150 will detonate upon ignition of the igniter(s) 120, 135. For example, the connector 170 may prevent the secondary igniter 135 from falling into a cavity and become misaligned with the power charge 150 as discussed herein with regards to FIG. 6. The upper end 151 of the power charge 150 is connected to the firing head 110 via the adapter 130 to hold the power charge 150 in alignment with the igniter(s) 120, 135 to help ensure that the power charge 150 detonates upon the ignition of the igniter(s) 120, 135. The connector 170 may be configured to attach the upper end 151 of the power charge 150 directly to the firing head 110 depending on the configuration of the firing head 110 and/or adapter 130 as would be appreciated by one of ordinary skill in the art having the benefit of this disclosure. The configuration, size, and/or shape of the firing head 110, igniter 120, adapter 130, secondary igniter 135, housing 140, chamber 145, power charge 150, power charge casing 155, igniter 160, and/or connector 170 are shown for illustrative purposes and may be varied depending on the application as would be appreciated by one of ordinary skill in the art having the benefit of this disclosure.

Figure 2A:
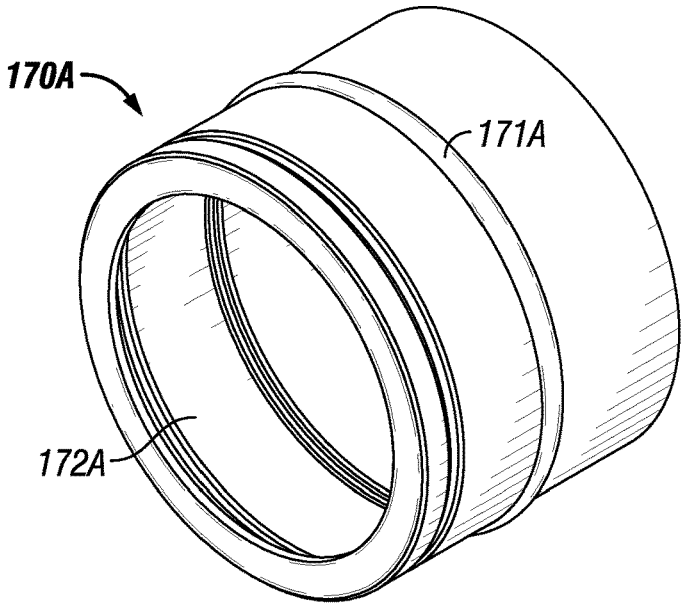
FIG. 2A shows a perspective view of an embodiment of a connector of a power charge.

FIG. 2A shows a perspective view of an embodiment of a connector 170A that may be used to connect the upper end of a power charge to a portion of a setting tool. The connector 170A includes an outer engagement feature 171A that is configured to engage with a mating feature of the portion of the setting tool. For example, the outer engagement feature 171A may be a raised projection that is configured to engage a corresponding slot or recess in a portion of the setting tool, such as a slot or recess in the adapter. Various shapes and/or configurations may be used for the outer engagement feature 171A and the mating feature on a portion of the setting tool to selectively connect the connector 171A to the setting tool as would be appreciated by one of ordinary skill in the art having the benefit of this disclosure. The connector 170A may include an inner engagement feature 172A that is configured to retain the upper end of a power charge within the connector 170A. For example, the inner engagement feature 172A may be a projection that engages a slot or recess located at the upper end 151 in the casing 155 of the power charge 150. Alternatively, the inner engagement feature 172A may simply press into the casing 155 of the power charge 150 depending on the material of the casing 155. For example, the inner engagement feature 172A may be pressed into a smooth casing 155 that is comprised of cardboard.

Figure 2B:
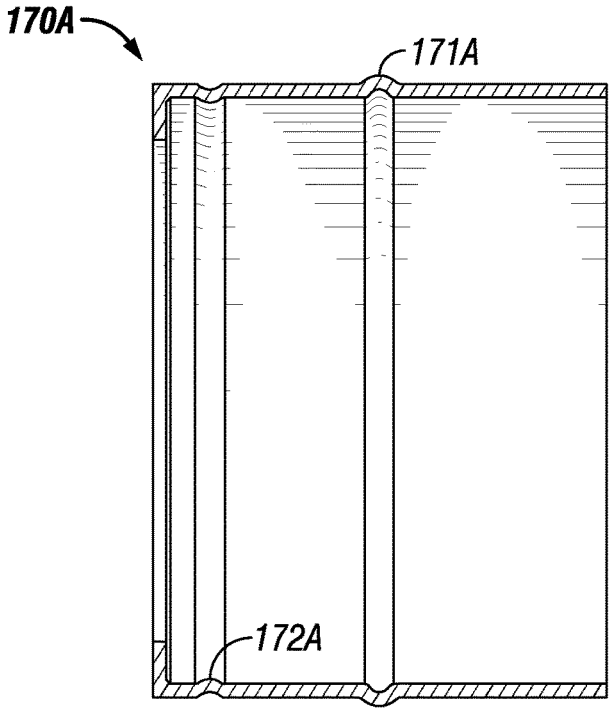
FIG. 2B shows a cross-section view of the connector of FIG. 2A.
Figure 2C:
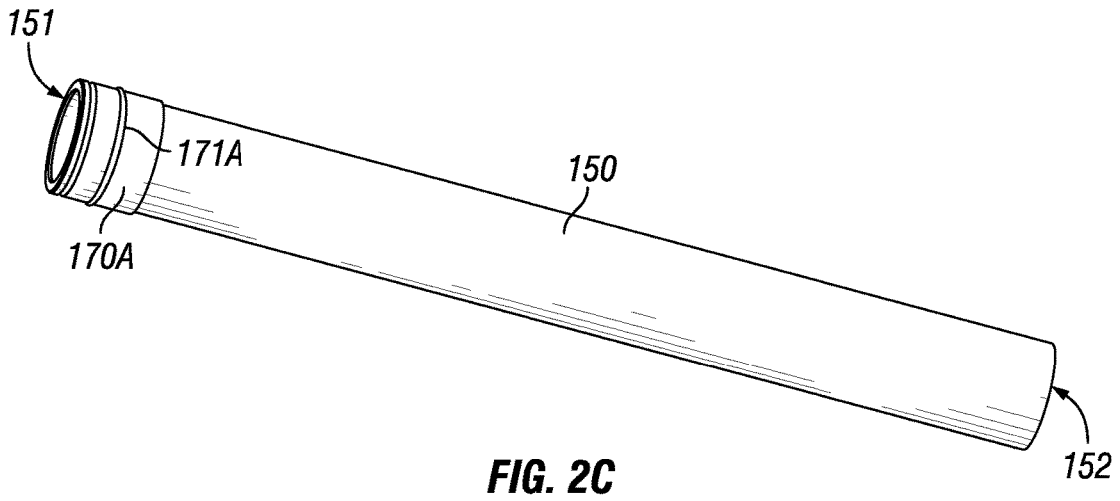
FIG. 2C shows a perspective view of the connector of FIG. 2A connected to an end of a power charge.

FIG. 2B shows a cross-section view of the connector 170A of FIG. 2A. As discussed herein, the connector 170A includes an outer engagement feature 171A configured to selectively connect the connector 170A to the setting tool and an inner engagement feature 172A configured to selective connect the connector 170A to the uphole end of a power charge. The depiction of the outer engagement feature 171A and inner engagement feature 172A are for illustrative purposes and may be varied as would be appreciated by one of ordinary skill in the art having the benefit of this disclosure. For example, a portion of the setting tool could include a projection configured to engage a recess on the connector 170A. FIG. 2C shows the connector 170A selectively connected to the upper end 151 of a power charge 150.

Figure 3A:
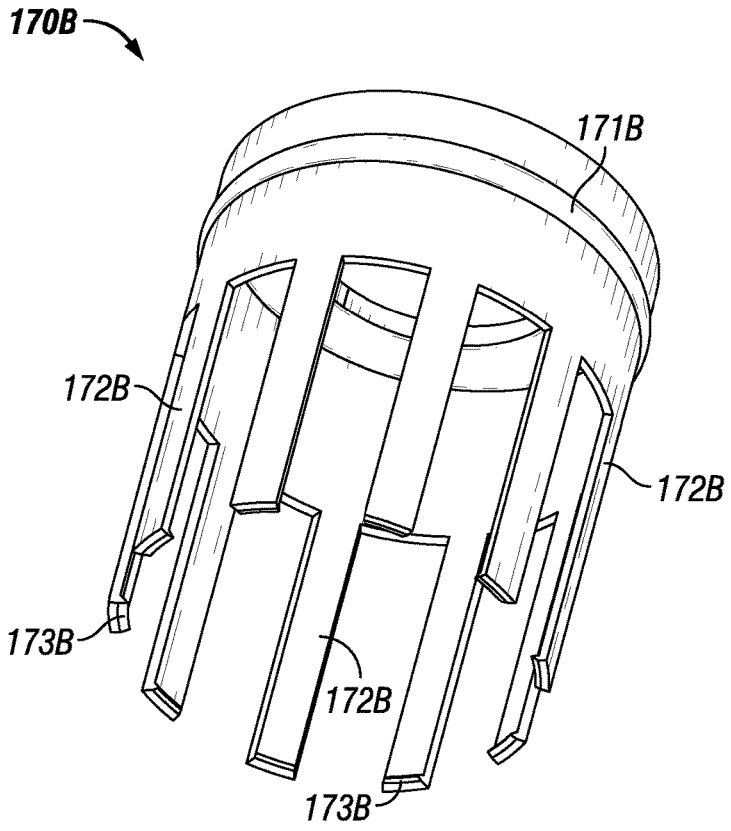
FIG. 3A shows a perspective view of an embodiment of a connector of a power charge.

FIG. 3A shows a perspective view of an embodiment of a connector 170B that may be used to connect the upper end of a power charge to a portion of a setting tool. The connector 170B includes an outer engagement feature 171B that is configured to engage with a mating feature of the portion of the setting tool. For example, the outer engagement feature 171B may be a raised projection that is configured to engage a corresponding slot or recess in a portion of the setting tool, such as a slot or recess in the adapter. Various shapes, locations, and/or configurations may be used for the outer engagement feature 171B and the mating feature on a portion of the setting tool to selectively connect the connector 171B to the setting tool as would be appreciated by one of ordinary skill in the art having the benefit of this disclosure. For example, the outer engagement feature 171B may be located on the exterior of the fingers 172B of the connector 170B.

The connector 170B includes a plurality of fingers 172B that may be used to selectively connect the connector 170B to a power charge. Each of the fingers 172B may include an inner engagement feature 173B configured to retain the upper end of a power charge within the connector 170B. For example, the inner engagement feature 173B may be a projection that engages a slot or recess located at the upper end 151 in the casing 155 of the power charge 150. Alternatively, the inner engagement feature 173B may simply press into the casing 155 of the power charge 150 depending on the material of the casing 155. For example, the inner engagement feature 172B may be pressed into a smooth casing 155 that is comprised of cardboard.

Figure 3B:
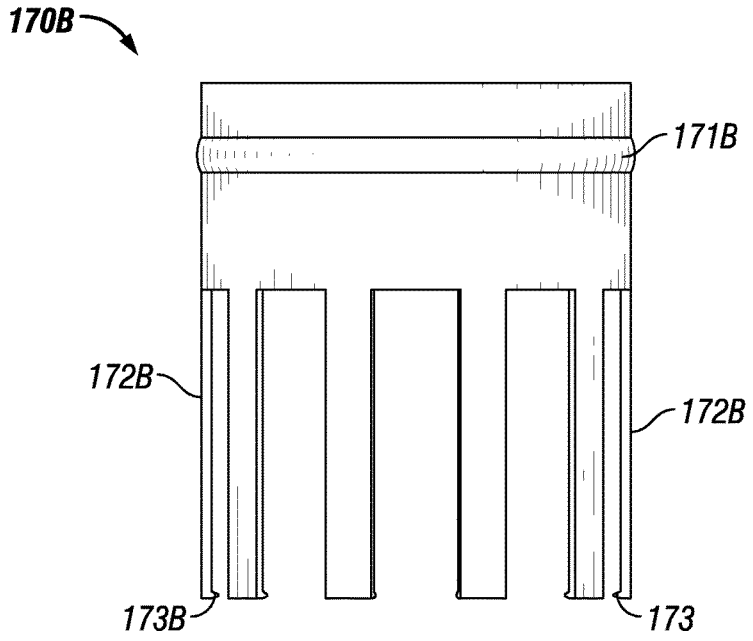
FIG. 3B shows a side view of the connector of FIG. 3A.
Figure 3C:
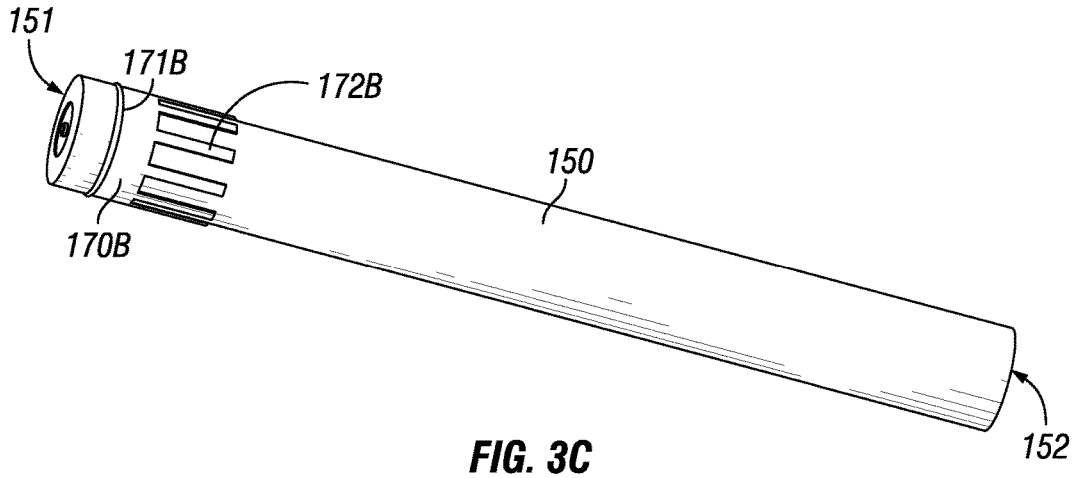
FIG. 3C shows a perspective view of the connector of FIG. 3A connected to an end of a power charge.

FIG. 3B shows a side view of the connector 170B of FIG. 3A. As discussed herein, the connector 170B includes an outer engagement feature 171B configured to selectively connect the connector 170B to the setting tool and an inner engagement features 173B on a plurality of fingers 172B each configured to selective connect the connector 170B to the uphole end of a power charge. The depiction of the outer engagement feature 171B, fingers 172B, and inner engagement features 173B are for illustrative purposes and may be varied as would be appreciated by one of ordinary skill in the art having the benefit of this disclosure. For example, a portion of the setting tool could include a projection configured to engage a recess on the connector 170B. FIG. 3B shows the connector 170B selectively connected to the upper end 151 of a power charge 150.

Figure 4:
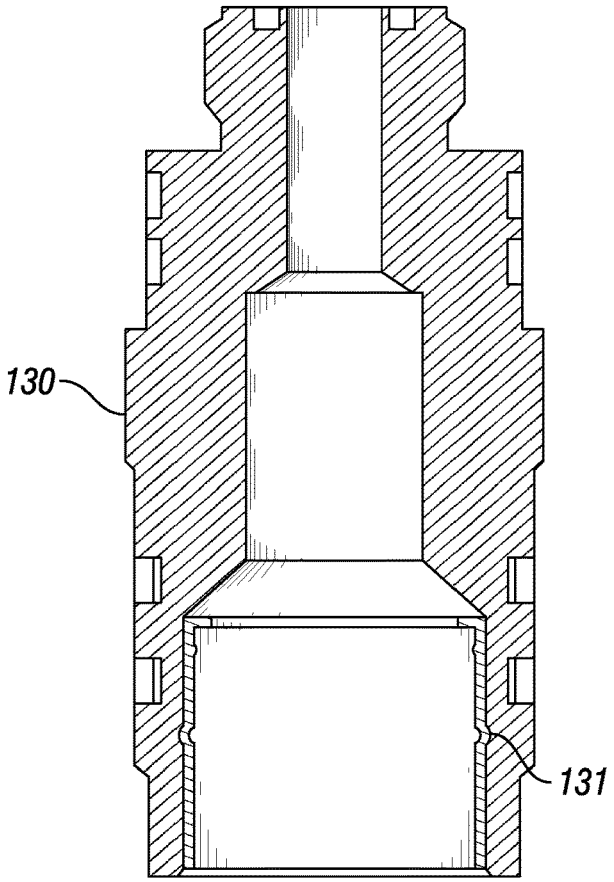
FIG. 4 shows an embodiment of an adapter that may be used in a downhole setting tool.

FIG. 4 shows an embodiment of an adapter 130 that may be used in a downhole setting tool 100. The adapter 130 includes a mating feature 131 that is configured to engage a feature on the connector 170 to selective retain the power charge 150 in alignment with the igniter 120. The configuration and/or location of the mating feature 131 may be varied to mate with a feature on the connector 170 as would be appreciated by one of ordinary skill in the art having the benefit of this disclosure. For example, the mating feature 131 may be configured to engage with the projection 171A on connector 170A or the mating feature 131 may be configured to engage with projection 171B on connector 170B. Alternatively, the mating feature 131 may be integrated on the firing head 110 or a different component of the downhole setting tool 100 to selectively retain the power charge 150 in alignment with an igniter 120 and/or 135 of the setting tool 100 as would be appreciated by one of ordinary skill in the art having the benefit of this disclosure.

Figure 5:
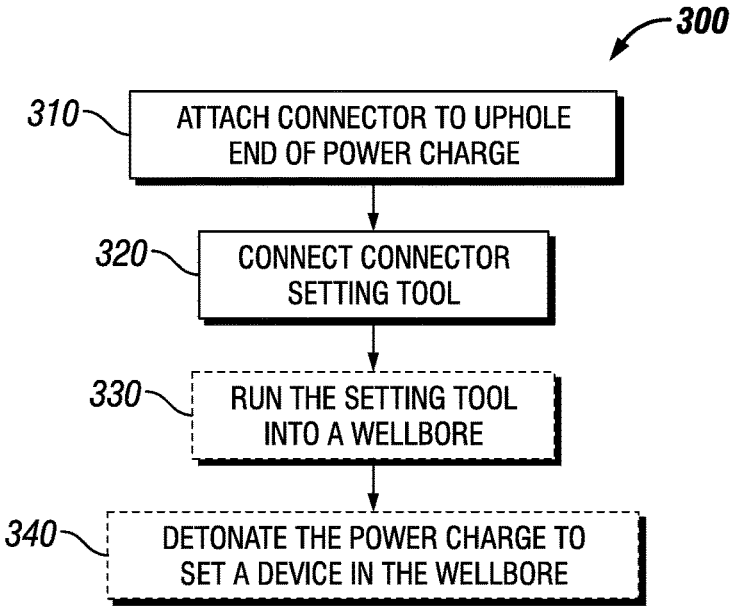
FIG. 5 shows a flow chart of an embodiment of a method of using a downhole setting tool.

FIG. 5 is a flow chart of an embodiment of a method 300 of using a downhole setting tool. The method 300 includes attaching a connector to a power charge configured to be selectively detonated to set a device in a wellbore, at step 310. The method 300 includes connecting the power charge to a portion of a downhole setting tool via the connector, at step 320. As discussed herein, the power charge may be connected to an adapter within the setting tool via the connector by mating features. The method 300 may include running the setting tool into a wellbore, at step 330. The setting tool may be run to a desired location within a wellbore at which it is desired to set a device within the wellbore. The method may also include detonating the power charge to set the device in the wellbore, as step 340, with an electrical signal as disclosed in U.S. patent application Ser. No. 15/406,040 entitled "SETTING TOOL POWER CHARGE INITIATION" filed on Jan. 13, 2017, which is incorporated by reference herein in its entirety.

U.S. patent application Ser. No. 15/406,040 entitled "SETTING TOOL POWER CHARGE INITIATION" filed on Jan. 13, 2017 discloses a heater cartridge that is placed inside the power charge to aid in igniting the power charge. The connector disclosed herein may be used to retain the heater cartridge inside the power charge. An electrical current is applied to the heater cartridge and the connector disclosed herein may also provide a return connection for the electrical path from the heater cartridge. For example, the connector disclosed herein, which may be comprised of metal, may be in contact with the adapter disclosed herein providing an electrical return path for the electrical signal.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A tool comprising:

a firing head;

an igniter;

a housing connected to the firing head, the housing including a chamber;

a power charge positioned within the chamber;

an adapter positioned between the firing head and the power charge; and a connector directly connected to an uphole end of the power charge, wherein the adapter is positioned between the igniter and the connector, wherein the connector connects a portion of the power charge to the adapter, and wherein the power charge is connected to the firing head via the adapter.

2. The tool of claim 1, wherein power charge further comprises an outer housing, the connector connecting a portion of the outer housing to the adapter.

3. The tool of claim 2, wherein the connector further comprises a ring having an outer engagement feature and an inner engagement feature.

4. The tool of claim 3, wherein the outer engagement feature engages a mating feature of the adapter and wherein the inner engagement feature engages a mating feature of the power charge.

5. The tool of claim 2, wherein the connector further comprises a collet having a plurality of fingers.

6. The tool of claim 5, wherein the collet includes an outer engagement feature configured to engage a mating feature of the adapter and wherein each of the plurality of fingers include an inner engagement feature configured to engage a mating feature on the power charge.

7. The tool of claim 1, wherein the igniter is actuated by an electrical signal from an electrical conduit.

8. The tool of claim 7, wherein the actuation of the igniter detonates the power charge.

9. The tool of claim 8, wherein the detonation of the power charge sets a tool within a wellbore.

10. The tool of claim 7, wherein the actuation of the igniter ignites a secondary igniter that detonates the power charge.

11. The tool of claim 1, wherein a portion of the adapter is positioned between the connector and the housing.

12. A method of using a downhole setting tool comprising:

attaching a connector directly to an uphole end of a power charge configured to be selectively detonated to set a device within a wellbore; and connecting the power charge to an adapter via the connector;

connecting the adapter to a firing head; and connecting the firing head to a housing, wherein the power charge is positioned within a chamber within the housing, wherein an igniter is positioned between the adapter and the firing head, and wherein the igniter may be selectively actuated via an electrical signal via an electrical conduit.

13. The method of claim 12, further comprising running the downhole setting tool into the wellbore.

14. The method of claim 13, further comprising detonating the power charge to set the device in the wellbore.

15. The method of claim 12, wherein connecting the power charge to the adapter further comprises engaging a mating feature of the adapter with an outer engagement feature of the connector.

16. A power charge comprising:

a power charge configured to be detonated to set a tool within a wellbore, the power charge having an uphole end and a downhole end when installed within a downhole setting tool, the power charge including an outer housing; and a connector, the connector comprising a ring configured to attach directly to the uphole end of the outer housing of the power charge, the connector including an inner engagement feature configured to retain the uphole end of the power charge and the connector including an outer engagement feature.

17. The power charge of claim 16, wherein the inner engagement feature is configured to engage a mating feature on the outer housing of the power charge.

18. The power charge of claim 17, wherein the connector further comprises a collet having a plurality of fingers, wherein each finger includes the inner engagement feature.

19. A method of actuating a downhole tool having an actuation mechanism for receiving a mechanical force generated by a detonation of a power charge in a downhole setting tool, the power charge having an uphole end and a downhole end when installed within the downhole setting tool, a connector including an outer engagement feature connected directly to the uphole end of the power charge, the method comprising:

attaching the connector directly to the uphole end of the power charge;

connecting the power charge to an adapter via the connector;

connecting the adapter to a firing head, wherein an igniter is positioned between the adapter and the firing head;

selectively actuating the igniter in the downhole setting tool via an electrical signal to selectively detonate the power charge;

generating a mechanical force upon detonation of the power charge; and transmitting the mechanical force to the actuation mechanism adapted to actuate the downhole tool.

20. The method of claim 19, wherein actuation of the downhole tool comprises one or more of setting, releasing, or shifting the downhole tool.

21. The method of claim 20, wherein the downhole tool comprises one or more of a packer, frac plug, bridge plug, valve, and sleeve.

* * * * *